US006699367B2

(12) United States Patent
Gstrein et al.

(10) Patent No.: US 6,699,367 B2
(45) Date of Patent: Mar. 2, 2004

(54) PAPERMAKER'S FELT

(75) Inventors: Hippolit Gstrein, Gloggnitz (AT); Wolfgang Friesenbichler, Edlitz (AT)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 09/933,026

(22) Filed: Aug. 20, 2001

(65) Prior Publication Data

US 2002/0066547 A1 Jun. 6, 2002

(30) Foreign Application Priority Data

Aug. 21, 2000 (DE) ..... 100 40 828

(51) Int. Cl.[7] ..... D21F 7/08

(52) U.S. Cl. ..... 162/358.2; 162/900; 139/383 A; 442/192; 442/270

(58) Field of Search ..... 162/205, 206, 162/306, 358.1, 358.2, 358.4, 900–904; 139/383 A, 383 AA, 425; 34/111, 115, 120; 442/181, 189, 192, 270–272

(56) References Cited

U.S. PATENT DOCUMENTS

| | | | | |
|---|---|---|---|---|
| 3,049,153 A | | 8/1962 | Jones | |
| 4,105,495 A | | 8/1978 | Pai | |
| 4,151,323 A | | 4/1979 | Christie | |
| 4,323,622 A | | 4/1982 | Gladh et al. | |
| 4,350,731 A | * | 9/1982 | Siracusano | 139/383 A |
| 4,425,392 A | * | 1/1984 | Oikawa et al. | 139/383 A |
| 4,503,113 A | * | 3/1985 | Smart | 139/383 A |
| 4,632,716 A | | 12/1986 | Smith | |
| 4,839,220 A | | 6/1989 | Stijntjes et al. | |
| 5,087,327 A | * | 2/1992 | Hood | 139/383 A |
| 5,368,696 A | | 11/1994 | Cunnane, III et al. | |
| 5,391,419 A | * | 2/1995 | Davenport | 139/383 AA |
| 5,508,094 A | * | 4/1996 | McCarthy et al. | 139/383 R |
| 5,514,438 A | | 5/1996 | Crook, Jr. | |
| 5,525,410 A | * | 6/1996 | Hansen | 139/383 A |
| 5,618,612 A | * | 4/1997 | Gstrein | 139/383 A |

FOREIGN PATENT DOCUMENTS

| | | |
|---|---|---|
| CA | 711428 | 6/1995 |
| DE | 39 30315 A1 | 7/1990 |
| DE | 198 19 641 A1 | 7/1999 |
| EP | 0 502 635 A1 | 9/1992 |
| EP | 0 947 626 A1 | 10/1999 |
| GB | 966741 | 8/1964 |

* cited by examiner

*Primary Examiner*—Steven P. Griffin
*Assistant Examiner*—Eric Hug
(74) *Attorney, Agent, or Firm*—Myers Bigel Sibley & Sajovec

(57) ABSTRACT

Felt for use in a paper machine, with a textile backing element (20, 60) that comprises threads oriented transversely (30) and longitudinally (40) with respect to the direction of transport of the paper machine, and onto which fibres are needled to form a felt structure, wherein at least some of the transverse threads (30) exhibit a twisted structure (10).

23 Claims, 1 Drawing Sheet

PAPERMAKER'S FELT

CLAIM FOR PRIORITY AND CROSS-REFERENCE TO OTHER APPLICATIONS

This application claims priority to German Application No. 100 40 828.1, filed Aug. 21, 2000, the disclosure of which is hereby incorporated herein by reference.

FIELD OF THE INVENTION

The invention relates to a seamed felt such as is variously employed in paper machines as a press felt to remove water from a web of paper.

For this purpose, in the paper machine the web of paper is pressed between two felts or between a felt and a roller, so that the water is removed.

BACKGROUND OF THE INVENTION

For reasons of operating safety and to shorten the time during which the machine must be stopped for installation of the felts, seamed felts are increasingly being used on the paper machine in the lower and intermediate speed range and for papers with relatively low quality requirements. As a rule, these felts are composed of a woven backing fabric of coarse monofils in the longitudinal and transverse directions, with a monofil diameter in the range 0.35 mm to 0.5 mm. Onto this fabric fibres are needled in the conventional manner to form a felt-like structure.

The disadvantage of this backing-fabric concept lies in the poor anchoring of the fibres and the increased frictional wear and tear of the press felt, the tendency of the coarse backing fabric to leave marks on sensitive papers, and the low damping capacity of the felt on vibration-sensitive press positions.

In order to eliminate the problem of poor fibre anchoring, in the past attempts have been made to use curled yarns, as is described for example in the patent EP 0 502 638 A1. However, the curling of such yarns makes it difficult to work with them. Furthermore, it is difficult to produce and maintain a specific and reproducible curling of the yarns, in particular when different kinds of fibre materials are used.

A similar attempt to eliminate the above-mentioned disadvantages is disclosed in DE 39 30 315, which describes felts with braided yarns in the long direction with respect to the direction of movement of the endless band in the paper machine. Here, however, it has proved disadvantageous that on one hand the manufacture of braided yarns is elaborate and expensive, whereas on the other hand the felts made with these braided yarns show a declining elasticity and/or an impermanent or temporally unspecified stability.

The patent U.S. Pat. No. 5,514,438 describes felts for use in a paper machine, in which wound yarns are employed in the long direction with respect to the direction of movement of the endless band in the paper machine. These wound yarns consist of monofils surrounded by a layer or several layers of multifils. This embodiment, too, has so far proved to be suboptimal, because the construction of the wound yarns is very complex and hence they are complicated and expensive to manufacture.

SUMMARY OF THE INVENTION

The objective of the invention is thus to make available felts in which the fibre anchoring is improved in comparison to the known state of the art and which have a lower tendency to leave marks as well as a higher damping potential in comparison to the known state of the art.

For this purpose the invention includes the essential idea of improving the seamed felts previously used in paper machines by using structured fibres not only as the longitudinal threads of a basic textile area used as backing fabric, i.e. those aligned with the direction of movement, but also as the transverse or weft threads, which run substantially in the perpendicular direction. It further includes the idea of providing a twisted structure in which monofils, each of which in itself has a helical construction, are entwined with one another.

It has proved advantageous for the twisted structure to have a substantially round cross section. Surprisingly, it has been found particularly advantageous for this cross-sectional shape to be formed by entwining three monofils with one another, because when three monofils are used, an approximately homogeneous and substantially circular cross section is achieved over the entire length of the twisted structure. Another substantial advantage of the use of three monofils to produce the twisted structure lies in the fact that it is easy to handle threads that are not too thin, whereas the overall diameter of the twisted structure must not become too large, and this is enabled by the use of several monofils. Furthermore, three monofils provide adequate stability, so that an optimal combination of stability and flexibility is achieved.

In contrast, a twisted structure made of only two monofils has a cross section in the shape of two circles side by side, while a twisted structure made of four monofils has a substantially four-cornered shape with rounded corners. Furthermore, the diameter of the twisted structure as a whole increases, the more monofils are incorporated therein, so that the twisted structure in itself becomes more rigid and hence more difficult to work with. In principle, however, twisted threads made of five or more individual monofils are possible, in which case the diameter of each individual strand is made smaller.

The textile backing elements are constructed in at least two-ply form. This minimally two-ply backing element (see FIG. 1=duplex design) forms the basis for combinations with one or more woven fabrics which, laid over or under the backing fabric, can be connected thereto by means of needles. For special applications it is also possible to place two seamed backing fabrics (see FIG. 2=laminate) one over the other and join them together by needling or adhesive technology to form a backing element. Such backing elements make it possible to dispose between the woven layers other layers of fibres suitable for forming a felt-like structure.

According to another advantageous design, it is likewise possible to provide between the layers of the textile backing element special damping layers that have a suitable structure and are made of a material suited to the particular application.

Preferably when the textile backing element is constructed in several-ply form, at least one upper ply of longitudinal threads is connected to a lower ply, in which case the seam loop can be formed between upper and middle, upper and lower or middle and lower ply. The advantage of this and similar constructions lies in the greater thickness, lower tendency to leave marks and better damping in comparison to a two-ply or a laminated backing element. Owing to the inclusion of an additional ply of longitudinal threads by weaving technology, the textile backing element gains stability.

This stabilizing effect on the felt, combined with preservation of its mobility, in particular in the region of rollers over which the felt passes during operation of the paper machine, is reinforced by the twisted structure of the transverse threads. The twisting of the monofils makes it possible for the threads used to produce the felt to penetrate into and/or through the twisted structure between the monofils, and thus to be optimally anchored in the backing fabric. When plain monofils are used instead of a twisted structure, such anchoring is impossible.

This kind of anchoring is just as impossible when braided or curled yarns are used, because these have an elastic component and therefore with respect to their structure exhibit a distinctly weaker cohesion of the threads. Fibres needed to produce a felt cannot become securely attached to these curled or braided yarns and/or to monofils that have been worked into such yarns, so that under load a migration of the fibres out of the structure formed by curled or braided yarns is practically unavoidable.

In contrast, felts manufactured with a twisted structure in their textile backing fabric exhibit a distinctly improved long-term stability because here, as a result of the firm intertwining or twisting together of the monofils, once the fibres have penetrated into the twisted structure they are permanently anchored there; outward migration is hardly possible and practically never occurs.

According to another embodiment of the invention the twisted structure has a multiply twisted form; that is, in a first step monofils are joined together to form a twisted structure but then several such twisted structures are in turn entwined with one another.

By this means it advantageously becomes possible to affect the above-mentioned stability properties in a specific manner, inasmuch as the fibres necessary to form the felt are given more or fewer possible routes for penetrating between monofils. The anchoring of the felt-like structure in the textile backing element by way of its felt fibres is better, the greater the number of anchoring possibilities available.

Furthermore, a good penetration of the textile backing element by fibres of the felt-like structure has the extremely advantageous effect of providing good transfer of liquid from the side of the felt that faces towards the wet paper through the textile backing element to the side of the felt facing away from the wet paper. Because the transfer of liquid within the felt is based substantially on the capillary forces operating therein, a good penetration of fibres through the textile backing element is crucial for this liquid transfer. Because, as mentioned above, a migration of fibres into or out of the twisted structure practically does not occur, the liquid-transfer performance of the felt is also practically constant over time.

The monofils should have a diameter in the range from 0.1 mm to 0.9 mm, preferably in the range from 0.1 mm to 0.5 mm, and especially preferably in the range from 0.1 mm to 0.3 mm. The diameter in any specific case will depend in particular on the number of monofils incorporated into the twisted structure, the use of three monofils being optimal. In this embodiment the individual monofils have a diameter in the range from 0.2 mm to 0.3 mm.

The twisted structure as a whole has a mean outside diameter in the range from 0.3 mm to 1.0 mm, preferably in the range from 0.4 mm to 0.8 mm and especially preferably in the range from 0.4 mm to 0.6 mm. A mean outside diameter in the range from 0.3 mm to 1.0 mm has proved to be particularly preferable because a twisted structure with this diameter can be optimally integrated into the structure of the textile backing element and hence into the felt.

In this way the disadvantageous tendency of known seamed felts to leave marks can be largely eliminated, so that in operation a felt in accordance with the invention no longer exhibits this tendency.

The felt in accordance with the invention has a transverse-thread density greater than 130 transverse threads per 10 cm, preferably in the range from 130 to 200 transverse threads per 10 cm, and especially preferably in the range from 140 to 180 transverse threads per 10 cm. The result is the extremely advantageous effect that its high transverse-thread density gives the textile backing element an approximately smooth surface, in which unevenness can occur only in the size range of fractions of the diameter of the particular monofil being used. Gaps between the individual transverse threads that would produce inhomogeneity of the textile backing element (for instance, in the form of a wave) are not present in the felt in accordance with the invention. Hence the high transverse-thread density of the textile backing element also creates optimal prerequisites for the felt in accordance with the invention to have no tendency to leave marks on the paper.

Furthermore, the homogeneous construction of the textile backing element and hence of the felt itself largely eliminates the possibility that oscillatory behaviour will be induced, so that even in vibration-sensitive positions of a paper machine the damping potential of the felt is improved in comparison to the state of the art and is preserved in the long term.

On the whole a particular advantage of the invention lies in the fact that the elasticity and/or stability of the felt in accordance with the invention can be optimally adjusted for the particular area of application, for instance the kind of paper to be dried, by suitable choice of the twisted structure.

BRIEF DESCRIPTION OF THE FIGURES

Other advantages and useful features of the invention will be apparent from the subordinate claims as well as the following description of preferred exemplary embodiments with reference to the figures, wherein

DETAILED DESCRIPTION OF THE INVENTION

Figure 1:
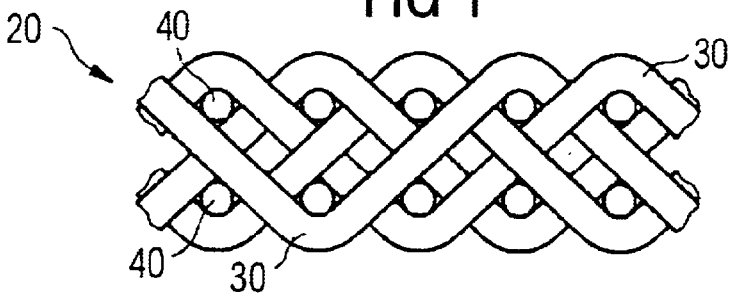
FIG. 1 is a schematic drawing of a two-ply textile backing element in accordance with the invention.

In the figures and in the following description, the same reference numerals are used for identical parts or parts with identical actions.

Figure 4:
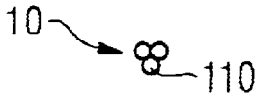
FIG. 4 is a schematic drawing of a twisted structure in accordance with the invention.

FIG. 1 shows schematically the structure of one layer of a two-ply textile backing element 20 in a section along transverse threads 30. These transverse threads 30, shown as single threads, are formed in a twisted structure and in cross section appear as three circles (FIG. 4), which symbolize the monofils 110 that form the twisted structure 10. It is likewise possible for the twisted structure 10 to be formed by structures that are themselves already twisted, or by a combination of monofils and twisted structures. The longitudinal threads 40 that form the seam loops, each of which runs into the plane of the picture, prefably have the form of monofils but can also, like the transverse threads, consist of twisted structures.

Figure 2:
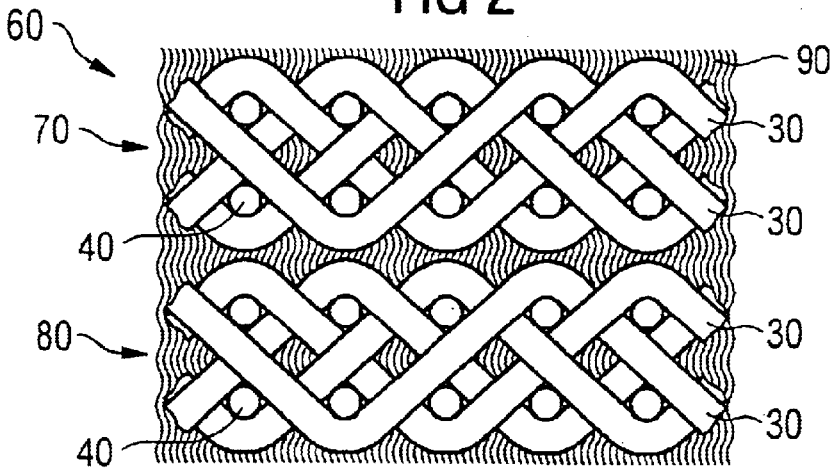
FIG. 2 is a schematic drawing of a laminated textile backing element in accordance with the invention.

FIG. 2 shows a laminated textile backing element 60, in which an upper layer 70 is disposed parallel to a lower layer 80 and spaced apart therefrom. Between the upper layer 70 and the lower layer 80, in accordance with this embodiment, fibers are disposed that have a felt-like structure and serve as a damping element. The region in FIG. 2 that encloses the upper layer 70 and the lower layer 80 shows schematically fibres 90 of which the felt is made.

As can be seen in FIG. 2, the fibres 90 penetrate through both the upper layer 70 and the lower layer 80 of the laminated textile backing element 60. The schematic structure of the upper layer 70 and the lower layer 80 is shown in section along the transverse threads 30. These transverse threads 30, shown as single threads, have a twisted structure according to FIG. 4. The longitudinal threads 40 running into the plane of the picture, which form the seam loops, preferably have the form of monofils but can also, like the transverse threads, consist of twisted structures.

The thickness of the above-mentioned damping element can be varied to suit the particular requirements. Another possibility is a three-layered design, in which between an upper and a middle layer, as well as between a middle and a lower layer, fibres are disposed to form a felt.

Figure 3:
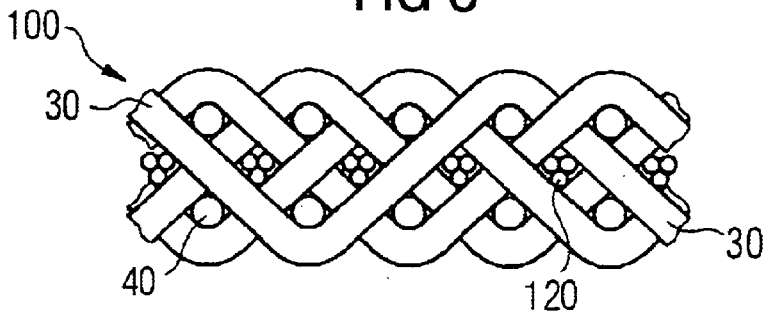
FIG. 3 is a schematic drawing of a three-ply textile backing element in accordance with the invention.

FIG. 3 shows schematically the structure of one layer of a three-ply textile backing element 100, in section along transverse threads 30, according to another embodiment of the invention. These transverse threads 30, again, have a twisted structure. And again it is possible for them to take the form of structures that are themselves already twisted, or a combination of monofils and twisted structures.

Here, again, the longitudinal threads 40 are preferably monofils but can also, like the transverse threads, be twisted structures. Between the longitudinal threads 40 that run into the plane of the picture an extra ply of threads 120 is woven in, to increase the distance between the longitudinal threads. This extra ply 120 can consist of monofils or of twisted thread structures. For the loop formation upper and middle, middle and lower, but preferably upper and lower longitudinal threads are used.

At this juncture it should once again be pointed out that according to one idea of the invention, by suitably selecting the monofils 110 a particular structured surface of the textile backing element can be obtained; for example, one variant is to use monofils 110 and/or twisted structures 10 and/or multiply twisted structures in alternation as transverse threads 30. By choosing suitable twisted structures 10, accordingly, a substantially smooth surface structure of the textile backing element can be produced.

Furthermore it is pointed out that all the parts described above are claimed as essential to the invention in themselves and in every combination, in particular also with respect to the details shown in the drawings. Modifications thereof will be familiar to those skilled in the art.

What is claimed is:

1. Seamed felt for use in a paper machine, with a textile backing element (20, 60, 100) that comprises threads oriented transversely (30) and longitudinally (40) with respect to the direction of transport of the paper machine, and onto which fibres (90) are needled to form a felt structure, characterized in that at least some of the transverse threads (30) exhibit a twisted structure (10) that is substantially circular in cross-section and that comprises at least three monofilaments firmly twisted together.

2. Felt according to claim 1, characterized in that the textile backing element (20, 60, 100) is constructed in at least two-ply form.

3. Felt according to claim 2, characterized in that two or more textile backing elements (60) are disposed one above another and, between upper and lower textile backing elements, fibres are embedded.

4. Felt according to claim 2, characterized in that longitudinal (40) and/or transverse (30) threads of at least one upper layer (70) of the textile backing element (60, 100) are connected to longitudinal (40) and/or transverse (30) threads of at least one lower layer (80) of the textile backing element.

5. Felt according to claim 1, characterized in that the twisted structure (10) is constructed as a mixed structure comprising monofils (110) and twisted and/or multiply twisted and/or spun and/or braided multifils.

6. Felt according to claim 1, characterized in that monofils (110) used to form the twisted structure have a diameter in the range from 0.1 mm to 0.9 mm.

7. Felt according to claim 1, characterized in that the twisted structure (10) has a mean outside diameter in the range from 0.3 mm to 1.0 mm.

8. Felt according to claim 1, characterized by a transverse-thread density above 130 transverse threads per 10 cm.

9. Seamed felt for use in a paper machine, with a textile backing element (20, 60, 100) that comprises threads oriented transversely (30) and longitudinally (40) with respect to the direction of transport of the paper machine, and onto which fibers (90) are needled to form a felt structure, characterized in that at least some of the transverse threads (30) exhibit a twisted structure (10) that is substantially circular in cross-section and that comprises at least three monofilaments twisted together, wherein each of the monofilaments itself has a helical construction.

10. Felt according to claim 9, characterized in that the textile backing element (20, 60, 100) is constructed in at least two-ply form.

11. Felt according to claim 10, characterized in that two or more textile backing elements (60) are disposed one above another and, between upper and lower textile backing elements, fibres are embedded.

12. Felt according to claim 10, characterized in that longitudinal (40) and/or tranverse (30) threads of at least one upper layer (70) of the textile backing element (60, 100) are connected to longitudinal (40) and/or transverse (30) threads of at least one lower layer (80) of the textile backing element.

13. Felt according to claim 9, characterized in that the twisted structure (10) is constructed as a mixed structure comprising monofils (110) and twisted and/or multiply twisted and/or spun and/or braided multifils.

14. Felt according to claim 9, characterized in that monofils (110) used to form the twisted structure have a diameter in the range from 0.1 mm to 0.9 mm.

15. Felt according to claim 9, chatacterized in that the twisted structure (10) has a mean outside diameter in the range from 0.3 mm to 1.0 mm.

16. Felt according to claim 9, characterized by a transverse-thread density above 130 transverse threads per 10 cm.

17. Seamed felt for use in a paper machine, with a textile backing element (20, 60, 100) that comprises threads oriented transversely (30) and longitudinally (40) with respect to the the direction of transport of the paper machine, and onto which fibres (90) are needled to form a felt structure, characterized in that at least some of the tranverse threads (30) exhibit a twisted structure (10) that is substantially circular in cross-section and that comprises at least three monofilaments twisted together, wherein each of the monofilaments has a diameter of between about 0.2 and 0.3 mm.

18. Felt according to claim 17, characterized in that the textile backing element (20, 60, 100) is construted in at least two-ply form.

19. Felt according to claim 18, characterized in that two or more textile backing elements (60) are disposed one above another and, between upper and lower textile backing elements, fibres are embedded.

20. Felt according to claim 18, characterized in that longitudinal (40) and/or transverse (30) threads of at least one upper layer (70) of the textile backing element (60, 100) are connected to longitudinal (40) and/or transverse (30) threads of at least one lower layer (80) of the textile backing element.

21. Felt according to claim 17, characterized in that the twisted structure (10) is constructed as a mixed structure comprising monofils (110) and twisted and/or multiply twisted and/or spun and/or braided multifils.

22. Felt according to claim 17, characterized in that the twisted structure (10) has a mean outside diameter in the range from 0.3 mm to 1.0 mm.

23. Felt according to claim 17, characterized by a transverse-thread density above 130 tranverse threads per 10 cm.

* * * * *